US005663518A

United States Patent [19]

Widmer

[11] Patent Number: 5,663,518

[45] Date of Patent: Sep. 2, 1997

[54] METHOD AND DEVICE FOR THE IN-FLIGHT CUTTING AND DISPENSING OF CHAFF DIPOLES FROM AN AERIAL VEHICLE

[75] Inventor: Marcel Widmer, Coral Springs, Fla.

[73] Assignee: Advanced Technology Materials, Inc., Danbury, Conn.

[21] Appl. No.: 254,712

[22] Filed: Jun. 6, 1994

[51] Int. Cl.[6] ..... B64D 1/00

[52] U.S. Cl. ..... 89/1.11; 102/505; 83/346; 244/136; 221/30

[58] Field of Search ..... 102/505; 244/136; 83/346; 221/30; 89/1.11

[56] References Cited

U.S. PATENT DOCUMENTS

| | | | |
|---|---|---|---|
| 3,027,047 | 3/1962 | Johnson | 221/30 |
| 3,519,221 | 7/1970 | Kifor | 343/18 |
| 3,547,000 | 12/1970 | Haberkorn et al. | 89/1.5 |
| 3,987,966 | 10/1976 | Ruda et al. | 239/687 |
| 4,167,008 | 9/1979 | Blickenstaff | 343/18 E |
| 4,417,709 | 11/1983 | Fehrm | 244/136 |

OTHER PUBLICATIONS

Hall et al, Theory and Problems of Machine Design, McGraw Hill, pp. 313–314.

Lundy "AN/ALE-43(V) Chaff Countermeasures Dispenser Set", distributor Jun. 7, 1993 at the Paris Air Show by Lundy Technical Center.

"Mini-Chaff Center Dispenser for Tactical Aircraft", presented in Jan., 1990 to the United States Navy by Lundy Technical Center as Proprietary Data.

Lundy "New Chaff Mini-Cutter", distributed Jun. 7, 1993 at the Paris Air Show by Lundy Technical Center.

*Primary Examiner*—Michael J. Carone
*Assistant Examiner*—Christopher K. Montgomery
*Attorney, Agent, or Firm*—Steven J. Hultquist; Janet R. Elliott

[57] ABSTRACT

A method for the self-protection of an aircraft or the like against radar-guided missiles and a self-protection device for use in aircraft and the like against radar-guided missiles, which enables in-flight cutting and dispensing of chaff dipoles of a preselected length into the airstream along the flight path of the aircraft. The device comprises a housing enclosing a motor having a flywheel providing a motor inertia that enables the motor to maintain a substantially constant rotational speed when a load is applied, a magnetic clutch, gearing for rotating a platen roller and a cutter roller, as well as means for controlling the operation of the device, and an exit opening with a spoiler for dispensing the cut dipoles into the airstream.

14 Claims, 6 Drawing Sheets

METHOD AND DEVICE FOR THE IN-FLIGHT CUTTING AND DISPENSING OF CHAFF DIPOLES FROM AN AERIAL VEHICLE

FIELD OF THE INVENTION

This invention relates to systems for the self-protection of aerial vehicles against radar-guided missiles, and more particularly it relates to a method and device for the in-flight cutting and dispensing of chaff dipoles into the airstream along the flight path of aircraft, helicopters, and other aerial vehicles.

BACKGROUND OF THE INVENTION

A conventional method for the self-protection of aircraft and the like from radar-guided missiles employs a chaff dispenser for ejecting chaff material in the form of pre-cut dipoles, or lengths of reflective or absorptive materials such as metallized glass or graphite fibers, into the airstream immediately along the flight path of the aerial vehicle. These pre-cut dipoles are cut and packaged at a factory in tubes or cartridges, typically made of a plastic, which are then placed in a dispensing device on the vehicles. One or more cartridges containing dipoles of a length selected in accordance with an expected radar frequency are fired from the dispensing device into the airstream where there is formed a cloud, or bloom, of the chaff which spoofs the radar and thereby provides protection of the vehicle.

There have also been used large bulk chaff dispensers that cut chaff dipoles in flight, but which are bulky, heavy and have a relatively slow response time. These bulk chaff dispensers have been used primarily for training and corridor seeding, as opposed to use for self-protection.

While such conventional systems have been found to be useful for enabling the self-protection of aircraft they present a number of problems, and an improved self-protection device has been needed for some time. Therefore, the device of the present invention has been developed to overcome problems associated with such conventional systems.

SUMMARY OF THE INVENTION

A primary object of the present invention is a method and a device for the in-flight cutting and dispensing of chaff dipoles, for use as a self-protection device against radar-guided missiles, which device has a reduced weight relative to conventional systems, while providing a fast response time and rapid chaff dipole dispense rate. Another object is such a device which enables a significant increase in effective chaff use events, while providing increased reliability. A further object is such a device providing flashless chaff ejection and no ejection of plastic parts into the air. Still another object is such a device having a threat adaptable replaceable cutter roller and a threat capability over a wide range of radar frequencies, for example, from 1 to 100 GHz. An additional object is such a device providing a lower cost dispenser acquisition and a lower cost chaff payload. Further, objects and advantages of the present invention may become apparent from the following description thereof and from the practice of the invention.

The objects of the present invention are accomplished by a device for the in-flight cutting and dispensing of chaff dipoles into an airstream along the flight path of an aerial vehicle comprising:

(a) rotatable cutter and platen rollers opposing each other;

(b) a drive motor having a drive shaft and a flywheel affixed thereto enabling the motor to maintain a substantially constant rotational speed when the dispense mode of the device is initiated;

(c) a gear assembly for connecting the drive shaft to at least one of the rollers;

(d) a clutch assembly for coupling and de-coupling the drive shaft to the gear assembly in response to a signal; and (e) control means for outputting a signal to the clutch assembly so as to activate the operation of the clutch assembly and control the rotation of the cutter roller.

In a preferred embodiment, the present invention comprises the foregoing elements further including a chaff roving storage compartment and a braking mechanism, enclosed in housing, as well as a guide means for guiding chaff roving into the nip of the rollers, an opening in the bottom of the housing below the rollers and a movable bottom cover/spoiler for alternately covering the opening when the device is not in use and serving as a spoiler to enable the exit of the dipoles into the airstream.

Another aspect of the present invention is a method of providing self-protection for an aerial vehicle against hostile radar-guided missiles, which method comprises:

(a) mounting on the vehicles a chaff cutter/dispenser mechanism for cutting chaff roving into chaff dipoles of a preselected length and dispensing the dipoles into an airstream along the flight path of the vehicle in response to a dispense signal;

(b) detecting a hostile radar signal while the vehicle is in flight;

(c) providing the dispense signal to the cutter/dispenser mechanism in response to the detected radar signal so as to activate the cutter/dispenser mechanism; and (d) cutting the chaff roving into the chaff dipoles and dispensing the chaff dipoles directly into the airstream.

BRIEF DESCRIPTION OF THE DRAWINGS

The present invention will be described hereinafter with reference to the accompanying drawings, wherein like numbers designate like elements and wherein.

DESCRIPTION OF A PREFERRED EMBODIMENT

Figure 1:
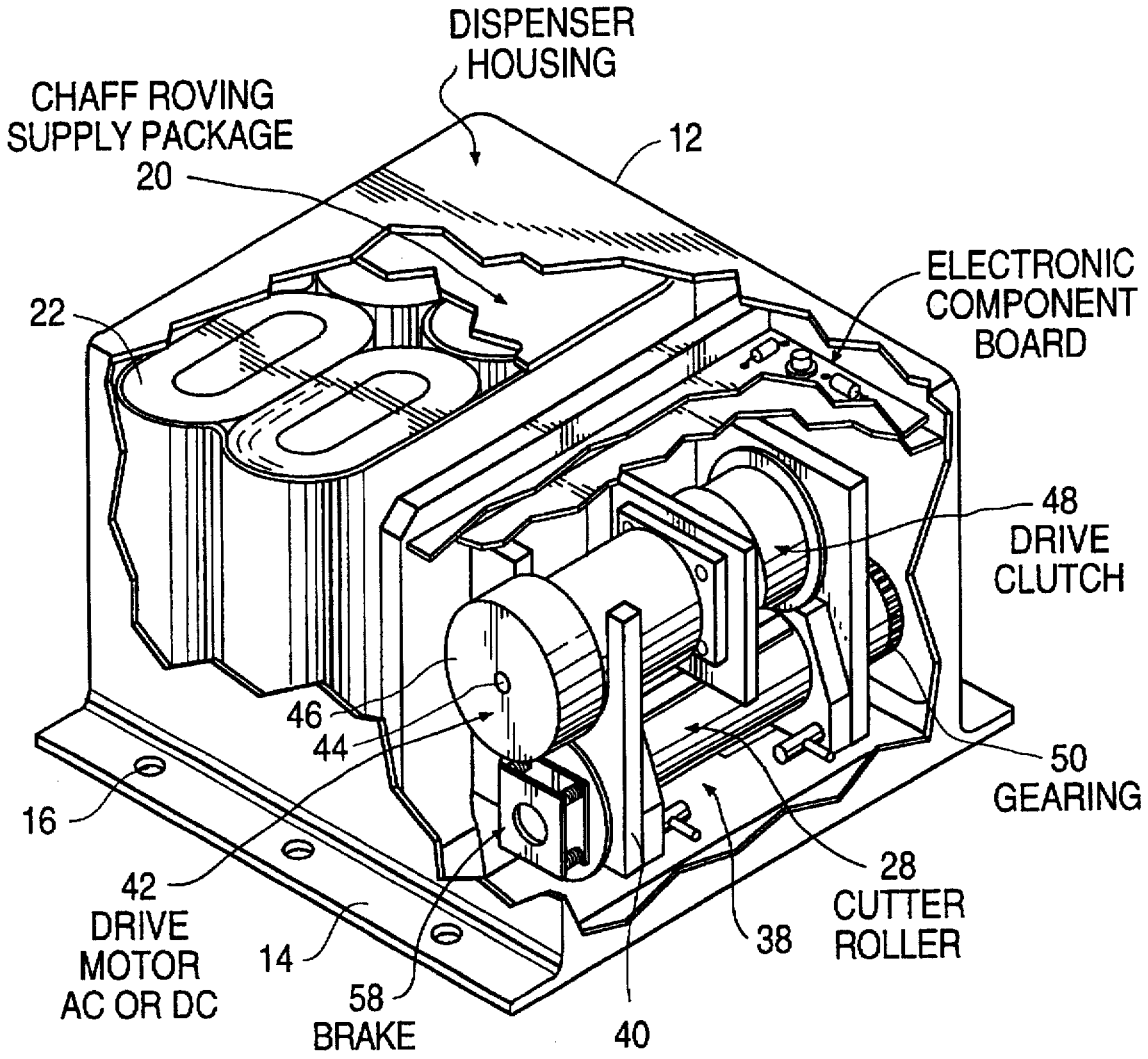
FIG. 1 is an orthographic projection illustrating a preferred embodiment of the present chaff cutter/dispenser, wherein the dispenser housing is partially cut away.
Figure 2:
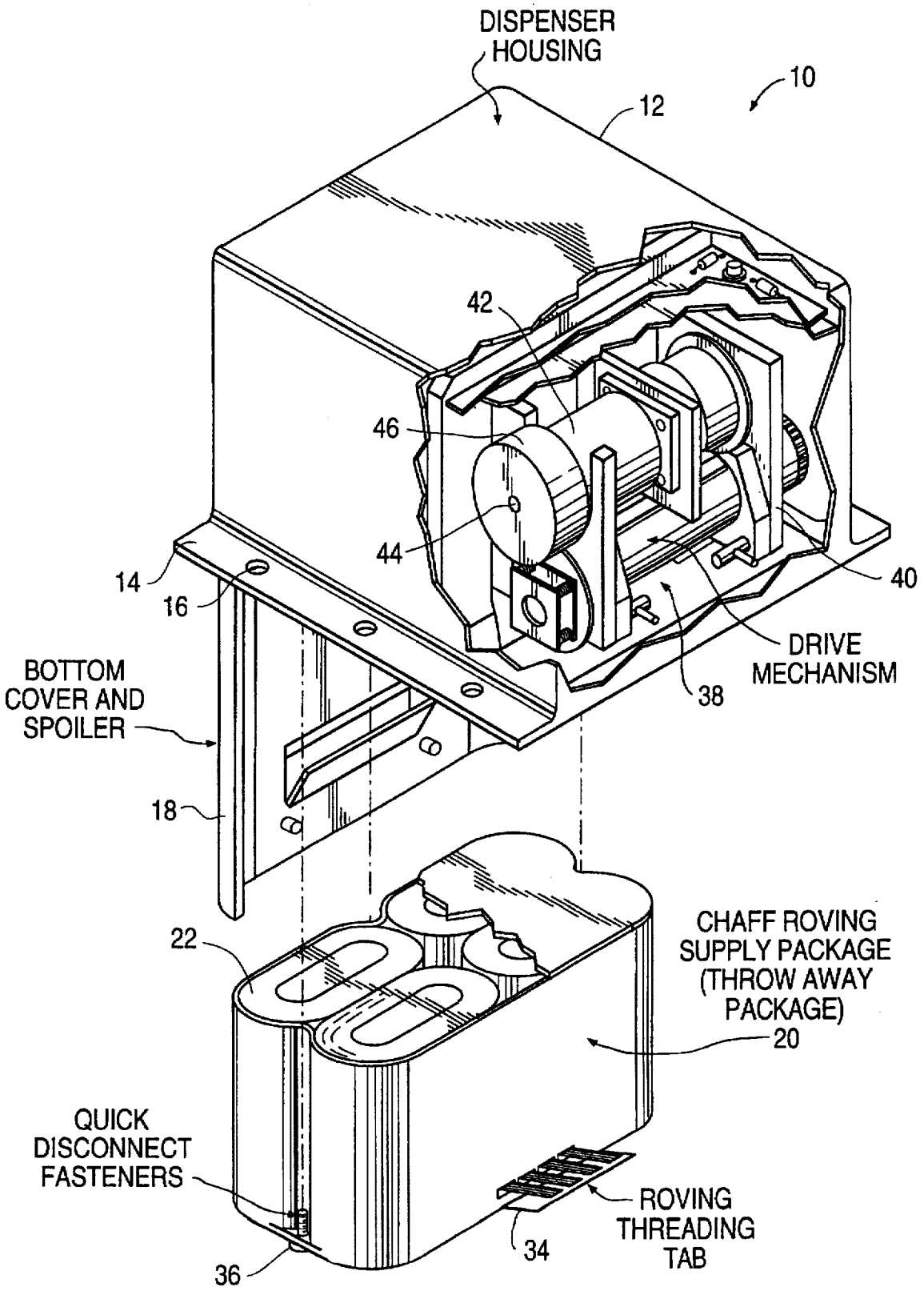
FIG. 2 is an orthographic projection of the cutter/dispenser of FIG. 1 illustrating a chaff roving supply package to be inserted in the device of the present invention.

Referring to FIGS. 1 and 2, the present chaff cutter/dispenser 10 comprises a housing member 12 having a flanged lower portion provided with openings 16 enabling the cutter/dispenser 10 to be attached with fasteners to an appropriate support located, for example, in the aft section of an aircraft fuselage (not shown). The housing member 12 is provided with a bottom cover 18 attached by hinges to the housing member so that chaff roving supply packages 20 containing multiple, e.g., four, helically wound bundles 22 of chaff roving (fibers twisted into flat, rope-like strands) may be readily inserted into and removed from the chaff roving storage compartment 19. The bottom cover 18 is provided with an elongated opening 24 extending along the length of and located below platen roller 26 and cutter roller 28, so that cut chaff dipoles fall through the opening and exit the housing 12. Inwardly extending wall members **30*a* and 30*b* on the forward and aft sides of the opening 24 assist the cut dipoles in exiting the housing 12, and a spoiler member 32 positioned outside the bottom cover 18 and extending along the forward side of the opening 24 assists in dispensing the dipoles into the airstream along the flight path of the aircraft. The spoiler 32** is retractable to a flush position when the dispenser is not in use.

As shown in FIG. 1, the chaff roving supply package 20, which is a removable roving storage module, contains a plurality, e.g., four chaff roving bundles 22 each having an elliptical cross section to provide a more space effective package. The chaff roving 23 preferably is formed of twisted strands of glass fiber of about 1 mil diameter coated with aluminum or another suitable metal, graphite fibers or other suitable materials providing the desired reflection or absorption of radio frequency energy. Such materials and their method of manufacture are well-known in this art. As shown in FIG. 2, the leading end of each of the strands of roving may be provided with a thin, flat roving threading tab 34 to facilitate the threading of the roving into the nip of rolls 26 and 28 when a fresh roving supply package 20 is inserted into the dispenser/cutter 10. The roving supply package 20 and housing 12 are fitted with quick disconnect fasteners 36 to facilitate the quick replacement of the supply package when the roving therein is exhausted.

Figure 4:
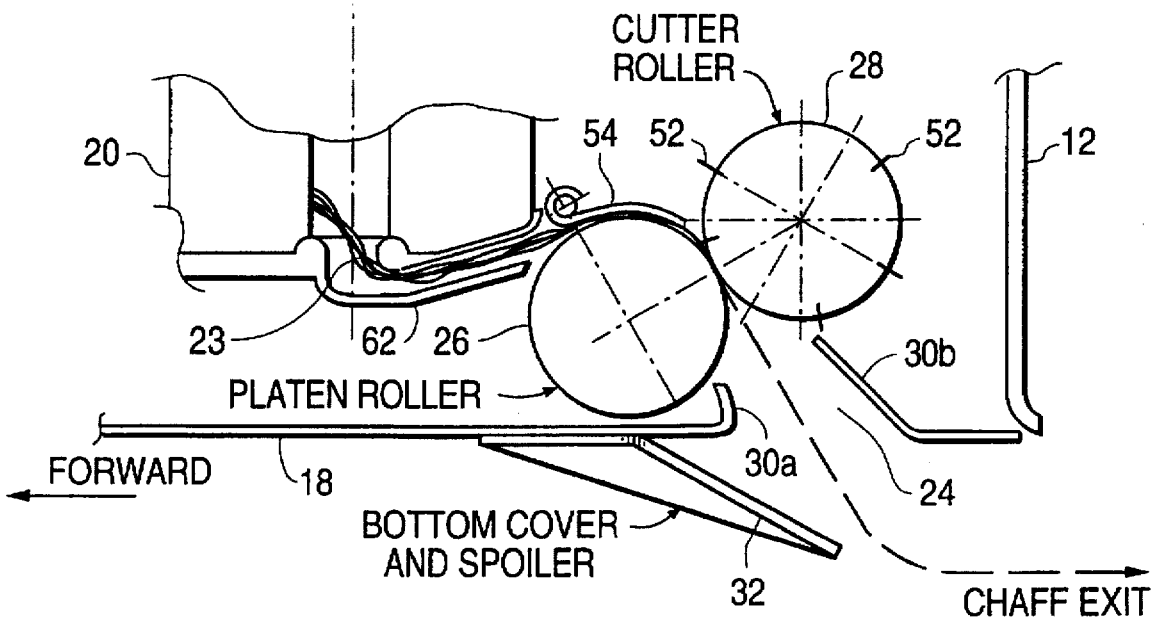
FIG. 4 is a sectional end view of the device of the present invention in the cutting position.

Referring to FIG. 4, a guide means 62 is positioned beneath the chaff roving compartment 19 and upstream of the rollers 26 and 28. The guide means 62 comprises a plurality, e.g., four, tubular members for guiding the rovings 23 from the chaff roving supply package 20 to the nip of rollers 26 and 28. When a fresh roving supply package 20 is inserted into compartment 19 the roving ends, which extend from a lower portion of the roving supply module 20, are pulled from the supply module and the threading tab 34 of each roving is threaded into the nip of rollers 26 and 28, so that when the rollers are rotated the rovings are drawn between the rollers from the interior of each of the wound chaff bundles 22 through the guide means 62.

Within the housing 12 and aft of wall 37 there is positioned a chaff cutting mechanism 38 mounted on a support member 40 secured to the housing. The cutting mechanism comprises a drive motor 42 having a drive shaft 44 and a flywheel 46 affixed to the outboard end of the drive shaft 44. The inboard end of drive shaft 44 is connected to the rotor (clutch face) of a drive clutch assembly 48, while the stator (electromagnetic clutch) of the clutch assembly is connected to a gear assembly 50 for driving each of the cutter roller 28 and the platen roller 26 to cause the opposing rollers to rotate in opposite directions. A gear reducer (not shown) may be used between the drive shaft 44 and the clutch face to reduce the speed to the desired speed, typically about 5000 r.p.m. Advantageously, the gear reducer is positioned on the drive shaft inside the motor housing.

The platen roller preferably is formed of rubber or another suitable elastomer, while the cutter roller 26 typically is formed of steel or another suitable material and has a plurality of cutter blades extending along the length of and spaced around the circumference of the roller 28 for cutting the strands of roving to a suitable length, depending upon the expected frequency of the threat radar. The knife-edge blades 52 are mounted in precisely machined grooves spaced around the circumference of the cutter roller, and the cutter roller is constructed in a manner well-known in the art. A pivotable pressure shoe 54 extends the length of the platen roller 26 for maintaining a slight pressure on the strands of roving drawn into the nip of rolls 26 and 28. Means may be provided for adjusting pressure of the blades 52 against the surface of the platen roller 26 to provide platen pressure optimization.

Figure 3:
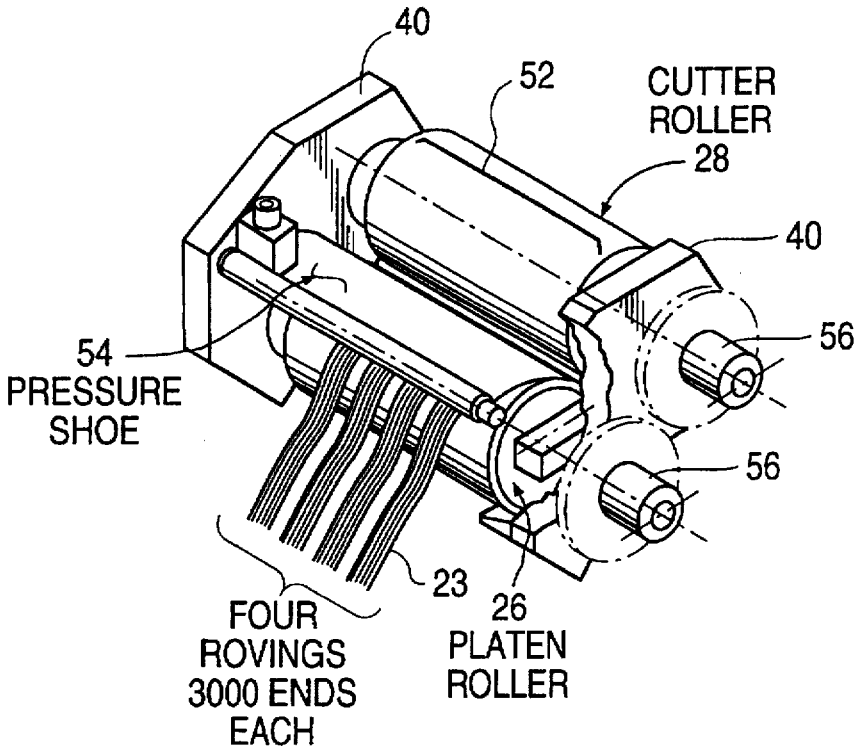
FIG. 3 illustrates a platen and roller assembly for use in the present invention.

Referring to FIG. 3, the platen roller 26 and the cutter roller 28 are held in the support member 40 by fasteners 56 which can be easily removed when it is desired to replace the rollers. FIG. 3 shows four rovings 23, typically having about 2,000 to 3,000 ends each, passing under pressure shoe 54 into the nip of rollers 26 and 28, and as roller 28 rotates each of the blades 52 presses the rovings against roller 26 with sufficient force to cut the rovings into dipoles, which are cut lengths of the fibers forming the roving. Thus, as the roving is cut, thousands of dipoles are formed. The spacing of the blades around the circumference of roller 28 will determine the length of the dipoles cut, and a number of replacement cutter rollers 28 may be supplied to enable the cutting of dipoles of varying lengths merely by changing the cutter roller. For example, the dipoles may be cut into lengths ranging from 5 inches down to 0.06 inches, and by selecting the appropriate cutter roller dipoles of the appropriate length can be cut and dispensed as a countermeasure for radar frequencies ranging from 1 to 100 GHz.

As shown in FIG. 1, the drive motor 42, supported on support member 40, has a drive shaft 44 with a flywheel 46 secured to the outboard end, and the inboard end of the shaft is keyed to the rotor of the magnetic clutch assembly 48 which may be activated upon receipt of an electrical signal to engage with gear assembly 50 to rotate rollers 26 and 28. Preferably, the gear assembly comprises a reduction gear in order to rotate the rollers at the desired speed, typically, about 3600 r.p.m. The details of such gears and their connections to the drive shaft and the rollers are well understood by those working in the mechanical arts and need not be described in detail herein.

During a flight, drive motor 42 runs continuously, without a load applied, in the standby condition, and when a radar threat occurs a signal sent to the clutch assembly 48 activates the magnetic clutch to cause the motor 42, through the gear assembly 50, to rotate rollers 26 and 28 which draw the rovings into the nip and cut the dipoles to a length determined by the spacing of blades 52. The motor inertia should be great enough so that when the load is placed on it, i.e., rotation of the clutch stator (electromagnetic clutch) is accelerated, the gears turn and the rollers rotate to cut the chaff roving, the motor continues to turn at substantially the same rotational speed as when in the standby condition. Thus, when use of the chaff cutter/dispenser is initiated by a signal to the clutch assembly dipoles of chaff are cut, fall through opening 24, and are dispensed into the airstream substantially instantaneously. Preferably, the motor inertia is sized to provide a response time of about 40 milliseconds, i.e., the cutter roller begins rotating and cutting the chaff roving into dipoles and the cutter roller is brought up to full operating speed, e.g. about 3600 r.p.m. within 40 milliseconds after receipt of a dispense signal to the clutch assembly.

An electric motor having the following performance and size parameters has been found to be suitable for use in the present invention:

| 115/208 v. 400 hz. 3 phase | |
|---|---|
| Speed | 4950 rpm rated |
| Torque | 10.8 in lbs. rated |
| Horsepower | 0.85 |
| Inertia | $150 \times 10^{-4}$ lb. in sec$^2$ |
| Diameter | 2.25" to 2.75" |
| Length | 3.25" to 3.50" |
| Shaft | 0.5" dia × 0.75" to 1.00" lng |
| Weight | 3 lbs. max |

The required motor inertia is provided by the flywheel 46 on the drive shaft 44, and when an electric motor having the required inertia is used in combination with the electromagnetic clutch and the reduction-type gear assembly, the required fast response time can be achieved.

If desired, a braking mechanism 58, for example a friction-type brake, positioned on the outboard end of the shaft of cutter roller 28, or both rollers 26 and 28 may be used to reduce the rotational speed of the cutting mechanism when the chaff cutter/dispenser is switched from the operating mode to a standby mode.

Figure 5:
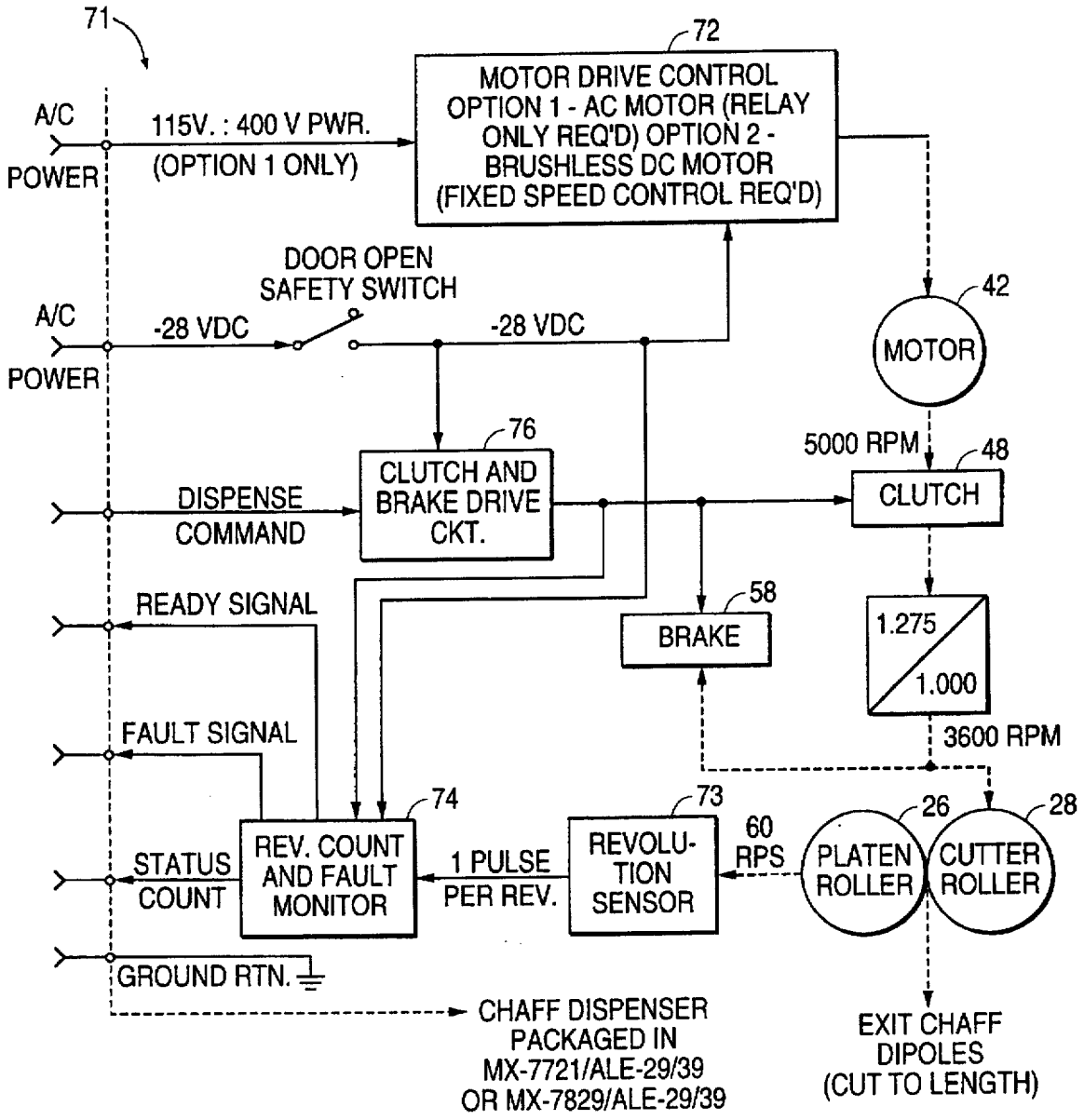
FIG. 5 is a functional block diagram of the cutter/dispenser mechanism of the present invention and an electronic interconnection box for receiving command signals from the control system of FIG. 5, a radar warning receiver and/or a programmable computer processor and converting the signals to be supplied to the mechanism of the present invention.
Figure 6:
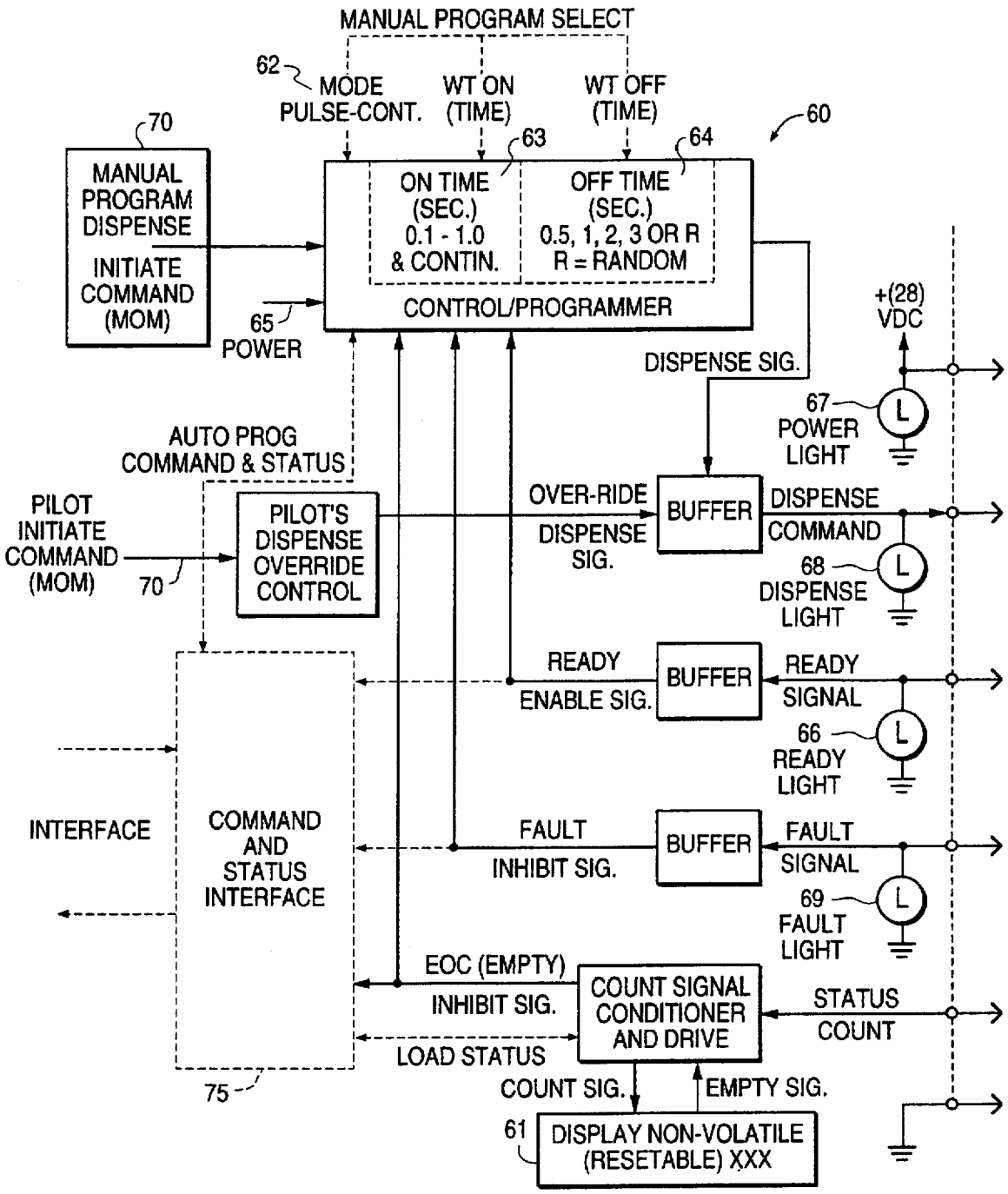
FIG. 6 is a functional block diagram of the electronic control system for directing the operation of the present chaff cutter/dispenser.
Figure 7:
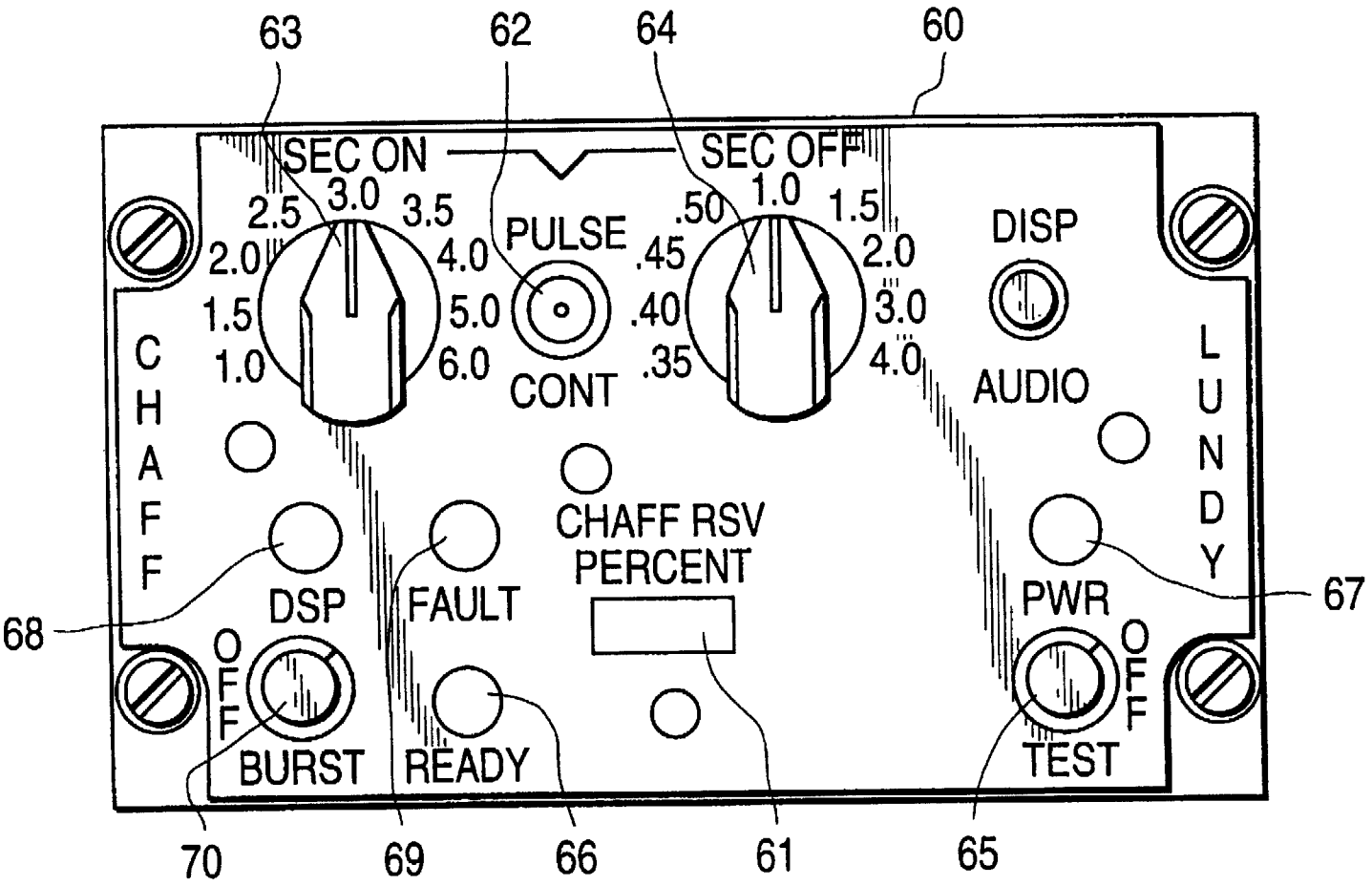
FIG. 7 is a front view of the panel of a control box of the device of the present invention.

Referring to FIGS. 5, 6 and 7, a control means 60, which includes a switching device, electrically connects an electric power supply to the drive motor 42, the clutch assembly 48 and brake mechanism 58 and outputs signals to each of these components to activate and/or deactivate the operations thereof and control the rotation of the cutter roller 28 and/or the platen roller 26.

Referring to FIGS. 5 and 6, the cutter/dispenser control means comprises a control box 60 connected to an interconnection box 71 and is used to perform the manual control of the cutting mechanism 38. The initial setting is to position counter 61, a chaff reserve counter used for indicating the percentage of chaff remaining in the chaff supply compartment, at a reading of 100. This indicates that the payload is at 100% of capacity.

A mode switch 62 selects the operating mode, which may be continuous or pulse. If the continuous mode is selected the dispenser will dispense chaff without interruption until the counter 61 indicates zero. At that time the machine will automatically shut off.

When the pulse mode is used ON 63 and OFF 64 times are selected on the control panel so that the cutter/dispenser operates in cycles having a range from 0.10 sec to 1.00 sec for ON and from 0.35 sec to 4.00 sec for the OFF timer.

The circuitry for the ON-OFF timing is located on a printed circuit board in the control box 60.

The other controls on the Control 60 box are:

a) Power Switch 65—When the power is applied the mechanism drive motor 52 comes up to speed, typically about 5000 rpm. When the motor is up to speed the Ready annunciator light 66 will illuminate, indicating that the dispenser is ready to dispense chaff when so commanded.

When the power is applied an annunciator light 67 above the power switch 65 will be illuminated. The power switch test position (down) tests all annunciator lights.

b) Dispense Switch 70—When the dispense switch is activated in the up position the mechanism will dispense chaff in the fashion selected by the mode switch 62 and the ON-OFF settings. The annunciator light 68 will illuminate during the actual dispensing period. The down position of the dispense switch 70 allows the ejection of a single chaff burst. The duration of the burst can be set at the factory. A fault light 69 will illuminate if the dispenser fails to dispense chaff at the required rate.

Electronic interconnection box 71 takes the commands from the control box 60 and transforms them into signal usable by the mechanism 38 to perform the required functions.

The power ON command 65, causes the switching of a relay 72, thereby applying the drive power to the motor 42.

The dispense command 70 causes the application of power 76 to the brake 58 to release the cutter roller and to the drive clutch 48 to drive the cutter roller 28 and platen roller 26.

A magnetic revolution sensor 73, located on the cutter roller shaft counts the number of shaft revolutions. This signal is processed 74 and used to generate the chaff reserve counter 61 reading on the Control box 60.

The Electronic interconnection box 71 may be modified to receive signals from an AN/ALE-39, AN/ALE-40 or AN/ALE-47 Programmer 75 to generate the command to the cutter/dispenser mechanism to provide the appropriate chaff dispensing response. Such programs are well-known in this art and need not be described herein.

The above-described chaff cutter/dispenser enables a compact, lightweight, fast response chaff cutter/dispenser which, when compared to conventional chaff dispensing system, has been found to provide a five or six to one increase in effective chaff use events, with up to 60 break lock events obtained from only 2 kg. of chaff. It provides a rapid response (40 milliseconds) to a radar threat and can dispense chaff dipoles of a selected length in a continuous or pulse mode.

Having described a preferred embodiment of the present invention, it is to be understood that variations and modifications thereof falling within the spirit of the invention may become apparent to those skilled in the art, and the scope of the present invention is to be determined by the appended claims and their equivalents.

What is claimed is:

1. A device for the in-flight cutting and dispensing of chaff dipoles into an airstream along the flight path of an aerial vehicle, which comprises:

(a) a housing member enclosing the following elements (b)–(h);

(b) a chaff roving storage compartment;

(c) a drive motor having a rotatable drive shaft;

(d) a flywheel affixed to the shaft enabling the shaft to maintain a substantially constant rotational speed when a dispense mode of the device is initiated;

(e) a rotatable cutter roller connectable to the drive shaft;

(f) a rotatable platen roller opposing the cutter roller;

(g) a gear assembly for connecting the drive shaft to at least one of the rollers for rotating the at least one roller;

(h) a clutch assembly for coupling and de-coupling the drive shaft to the gear assembly in response to a signal provided thereto;

(i) control means for outputting a signal to the clutch assembly so as to activate the operation of the assembly and control the rotation of the at least one roller;

(j) a braking mechanism for reducing the rotational speed of the at least one roller in response to a signal provided thereto;

(k) guide means on an upstream side of the rollers for guiding chaff from the chaff roving compartment into the nip of rollers so that rotation of the at least one roller causes the chaff roving to pass between the rollers and be cut into dipoles of a preselected length;

(l) an exit opening in a bottom side of the housing permitting cut dipoles to exit the device and pass into the airstream; and (m) a moveable bottom cover member attached to the bottom side of the housing for closing the opening when the device is not in use and for permitting the cut dipoles to exit the device into the airstream when cut dipoles are to be dispensed.

2. The device of claim 1, wherein in a standby condition the drive motor rotates the drive shaft at a preselected rotational speed, and the flywheel is sized to provide a motor inertia which enables the drive shaft to rotate at the preselected speed substantially instantaneously after the gear assembly is coupled to the drive shaft.

3. The device of claim 1, wherein the control means is manually activated.

4. The device of claim 1, wherein the control means is provided with an interface for connecting the control means to a radar warning receiver or to a programmable control system.

5. The device of claim 1, wherein the cutter roller is provided with a plurality of blades extending longitudinally along the cutter roller for cutting the chaff roving and the blades are spaced from each other circumferentially on the cutter roller.

6. The device of claim 5, further including a support member mounted in the housing for supporting the cutter roller and fastener means for securing the cutter roller to the support member and permitting the cutter roller to be readily interchanged with another cutter roller having a different spacing of blades on the roller.

7. The device of claim 6, wherein the platen roller is moveably mounted on the support member so as to be moveable upwardly from a chaff roving threading position beneath the cutter roller to a chaff roving cutting position.

8. The device of claim 1, wherein the clutch assembly includes a magnetic clutch.

9. The device of claim 1, wherein the bottom side of the housing member includes a bottom cover member hingedly attached to the housing member to swing downwardly so as to permit the insertion of a chaff roving supply package into the storage compartment, the exit opening is positioned in the bottom cover.

10. A device for the in-flight cutting and dispensing of chaff dipoles into an airstream along the flight path of an aerial vehicle, comprising:

(a) rotatable cutter and platen rollers opposing each other;

(b) a drive motor having a drive shaft and a flywheel affixed thereto enabling the motor to maintain a substantially constant rotational speed when a dispense mode of the device is initiated;

(c) a gear assembly for connecting the drive shaft to at least one of the rollers;

(d) a clutch assembly for coupling and de-coupling the drive shaft and the gear assembly in response to a signal supplied to the clutch assembly;

(e) control means for outputting a signal to the clutch assembly so as to activate the operation of the clutch assembly and control the rotation of the at least one roller;

(f) a chaff roving storage compartment;

(g) guide means on an upstream side of the rollers for guiding chaff from the chaff roving compartment into the nip of the rollers so that rotation of the at least one roller causes the chaff roving to pass between the rollers and be cut into dipoles of a preselected length for dispensing into said airstream; and (h) a braking mechanism for reducing the rotational speed of the at least one roller in response to a signal provided thereto.

11. The device of claim 10 further including an interface for connecting the control means to a radar warning receiver or a programmable computer processor.

12. A device for the in-flight cutting and dispensing of chaff dipoles into an airstream along the flight path of an aerial vehicle, which comprises:

(a) a housing member enclosing the following elements (b)–(j);

(b) a chaff roving storage compartment;

(c) a drive motor having a rotatable drive shaft;

(d) a flywheel affixed to the shaft enabling the shaft to maintain a substantially constant rotational speed when a dispense mode of the device is initiated;

(e) a rotatable cutter roller connectable to the drive shaft, wherein said cutter roller is provided with a plurality of blades extending longitudinally therealong, and spaced circumferentially on the cutter roller, for cutting the chaff roving;

(f) a rotatable platen roller opposing the cutter roller;

(g) a support member for supporting the cutter roller and said platen roller, said platen roller being moveably mounted on the support member so as to be moveable upwardly from a chaff roving threading position beneath the cutter roller to a chaff roving cutting position;

(h) a fastener means for securing the cutter roller to the support member and permitting the cutter roller to be readily interchanged with another roller cutter having a different spacing of blades on the roller;

(i) a gear assembly for connecting the drive shaft to at least one of the rollers for rotating the at least one roller;

(j) a clutch assembly for coupling and de-coupling the drive shaft to the gear assembly in response to a signal provided thereto;

(k) control means for outputting a signal to the clutch assembly so as to activate the operation of the assembly and control the rotation of the at least one roller;

(l) guide means on an upstream side of the rollers for guiding chaff from the chaff roving compartment into the nip of rollers so that rotation of the at least one roller causes the chaff roving to pass between the rollers and be cut into dipoles of a preselected length;

(m) an exit opening in a bottom side of the housing permitting cut dipoles to exit the device and pass into the airstream; and (o) a moveable bottom cover member attached to the bottom side of the housing for closing the opening when the device is not in use and for permitting the cut dipoles to exit the device into the airstream when cut dipoles are to be dispensed.

13. A device for the in-flight cutting and dispensing of chaff dipoles into an airstream along the flight path of an aerial vehicle, which comprises:

(a) a housing member enclosing the following elements (b)–(h);

(b) a chaff roving storage compartment;

(c) a drive motor having a rotatable drive shaft;

(d) a flywheel affixed to the shaft enabling the shaft to maintain a substantially constant rotational speed when a dispense mode of the device is initiated;

(e) a rotatable cutter roller connectable to the drive shaft;

(f) a rotatable platen roller opposing the cutter roller;

(g) a gear assembly for connecting the drive shaft to at least one of the rollers for rotating the at least one roller;

(h) a magnetic clutch assembly for coupling and de-coupling the drive shaft to the gear assembly in response to a signal provided thereto;

(i) control means for outputting a signal to the clutch assembly so as to activate the operation of the assembly and control the rotation of the at least one roller;

(j) guide means on an upstream side of the rollers for guiding chaff from the chaff roving compartment into the nip of rollers so that rotation of the at least one roller causes the chaff roving to pass between the rollers and be cut into dipoles of a preselected length;

(k) an exit opening in a bottom side of the housing permitting cut dipoles to exit the device and pass into the airstream; and (l) a moveable bottom cover member attached to the bottom side of the housing for closing the opening when the device is not in use and for permitting the cut dipoles to exit the device into the airstream when cut dipoles are to be dispensed.

14. A device for the in-flight cutting and dispensing of chaff dipoles into an airstream along the flight path of an aerial vehicle, which comprises:

(a) a housing member enclosing the following elements (b)–(h);

(b) a chaff roving storage compartment;

(c) a drive motor having a rotatable drive shaft;

(d) a flywheel affixed to the shaft enabling the shaft to maintain a substantially constant rotational speed when a dispense mode of the device is initiated;

(e) a rotatable cutter roller connectable to the drive shaft;

(f) a rotatable platen roller opposing the cutter roller;

(g) a gear assembly for connecting the drive shaft to at least one of the rollers for rotating the at least one roller;

(h) a clutch assembly for coupling and de-coupling the drive shaft to the gear assembly in response to a signal provided thereto;

(i) control means for outputting a signal to the clutch assembly so as to activate the operation of the assembly and control the rotation of the at least one roller;

(j) guide means on an upstream side of the rollers for guiding chaff from the chaff roving compartment into the nip of rollers so that rotation of the at least one roller causes the chaff roving to pass between the rollers and be cut into dipoles of a preselected length;

(k) an exit opening in a bottom side of the housing permitting cut dipoles to exit the device and pass into the airstream; and (l) a moveable bottom cover member hingedly attached to the bottom side of the housing to swing downwardly so as to permit the insertion of a chaff roving supply package into the storage compartment, wherein the exit opening is in the bottom cover.

* * * * *